United States Patent [19]

Tanigawa

[11] Patent Number: 4,839,486

[45] Date of Patent: Jun. 13, 1989

[54] MICROWAVE OVEN DAMPER MECHANISM ACTIVATED BY A SHAPE MEMORY ALLOY

[75] Inventor: Masanobu Tanigawa, Ikoma, Japan

[73] Assignee: Sharp Kabushiki Kaisha, Osaka, Japan

[21] Appl. No.: 484,460

[22] Filed: Apr. 13, 1983

[30] Foreign Application Priority Data

Jun. 9, 1982 [JP] Japan ..... 57-86281

[51] Int. Cl.[4] ..... H05B 6/64

[52] U.S. Cl. ..... 219/10.55 R; 219/10.55 A; 219/10.55 F; 16/82

[58] Field of Search ..... 219/10.55 F, 10.55 B, 219/10.55 R, 10.55 A, 10.55 M; 226/93 R, 101 E, 68 R; 333/105; 16/82, 85; 49/1, 5, 6, 379; 126/287.5; 98/96; 236/65 R, 93 R

[56] References Cited

U.S. PATENT DOCUMENTS 4,284,235 8/1981 Diermayer et al. ..... 236/1 G 4,369,347 1/1983 Shin ..... 219/10.55 B

*Primary Examiner*—E. A. Goldberg

*Assistant Examiner*—M. M. Lateef

*Attorney, Agent, or Firm*—Birch, Stewart, Kolasch & Birch

[57] ABSTRACT

A damper mechanism of a microwave oven using shape memory alloy spring elements for opening and/or closing the damper which, in turn, control the flow of air through an inlet port into the chamber. The damper mechanism is designed for extending the service lives of the shape memory alloy spring elements as well as an energy saving substitute for the power otherwise needed for driving the damper unit.

1 Claim, 5 Drawing Sheets

MICROWAVE OVEN DAMPER MECHANISM ACTIVATED BY A SHAPE MEMORY ALLOY

BACKGROUND OF THE INVENTION

The present invention relates to a microwave oven damper unit provided for the air blower inlet used for cooling the magnetron of the microwave oven with air being sent to the heating chamber.

Conventionally, existing microwave ovens provide any of the following three kinds of heating means; heating with microwave oscillated by a magnetron, a heater provided in the heating chamber, and convection heating that causes the heater-generated heat to circulate inside the heating chamber. The latest tendency indicates that a modern microwave oven can selectively perform any of these heating operations using these means built in together. Such an advantageous combination of these heating means enables the user to easily perform any desired cooking, thus providing more conveniences than before. A conventional microwave oven of this kind is typically designed so that air is internally fed by the blower motor through a number of punched holes on the surface of side panels of the heating chamber. Incoming air first cools the magnetron and peripheral parts before being fed to the heating chamber. A damper unit driven by a damper motor is provided just in front of the punched holes, where the damper is controlled so that it opens and closes the blower inlet connecting with the heating chamber. For example, when microwave heating is performed, the damper opens the blower inlet so that air is allowed to flow into the internal space of both the heating chamber and the blower duct. When heating is performed using either a heater or convection means, the damper is closed so that the cooling air flows only in the direction of the blower duct without being routed to the heating chamber, resulting in better heating efficiency. Cooling air flowing through the blower duct is externally exhausted from the microwave oven. Since the damper is driven by the damper motor by heating means and such a microwave oven must use an independent motor that is used to drive only the damper unit, such a damper mechanism actually counteracts the need for realizing cost reduction.

SUMMARY AND OBJECT OF THE INVENTION

In the light of such a disadvantage mentioned above, the present invention primarily aims at driving the damper unit by a spring means made of a shape memory alloy (element) without using any conventional damper motor so that the actual cost can be reasonably reduced. Of all the characteristics of such a shape memory alloy, any conventional spring means is based on a principle, which, by performing a heating operation using the "stress to distortion" characteristics while a low temperature phase (martensite phase) exists, the shape memorizing characteristics having the nature to return to the initially memorized original shape are applied to springs. Nevertheless, such a shape memorizing alloy still remains defective since the longer the heating time, the shorter the actual life of the alloy itself.

Another object of the present invention is to eliminate said defect by reducing the time as much as possible to feed current to the shape memory alloy by providing a damper unit that can satisfactorily retain the shape memorizing characteristics. To achieve these objects, while performing microwave heating, the present invention enables the current to flow to the spring made of the shape memory alloy so that the spring can activate the damper unit to open the blower inlet connecting with the heating chamber.

In these Figures, drawings denoted by (a) respectively show bird's-eye views, whereas drawing (b) respectively show side views observed from the direction A.

DETAILED DESCRIPTION OF THE INVENTION

General characteristics of the shape memory alloy (element) used for the preferred embodiment of the present invention are described below.

Figure 1:
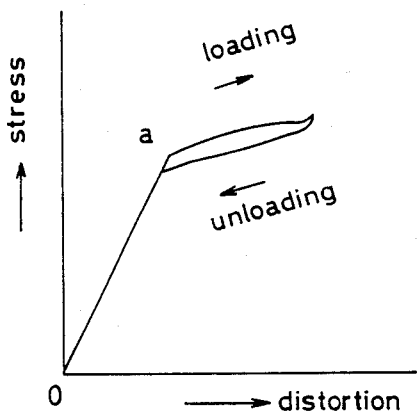
FIG. 1 shows the "stress to distortion" characteristics while the shape memory alloy used for the present invention still remains in a high temperature phase (austenite phase).

FIG. 1 shows the "stress to distortion" characteristics while a high temperature phase (austenite phase) still remains, where a super-elastic characteristic of said shape memory alloy in returning to the original shape is represented after it is freed from any distortion with its load being discharged, even though it may be subject to deformation beyond the apparent yield point "a".

Figure 2:
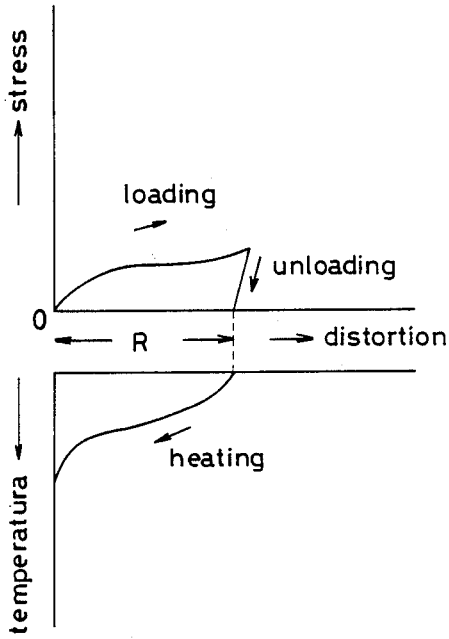
FIG. 2 shows the other "stress to distortion" characteristics while the shape memory alloy used for the present invention still remains in a low temperature phase (martensite phase).

FIG. 2 shows the other "stress to distortion" characteristics while a low temperature phase (martensite phase) still remains, where, even through a permanent distortion "R" will remain after the shape memory alloy is deformed beyond the apparent yield point "a", the shape memorizing characteristic of said shape memory alloy in returning to the initially memorized original shape by the heating effect is clearly represented. Typically, alloys comprising Ti-Ni, Cu-Al-Ni, and Cu-Al-Zn, are made available for composing a shape memory alloy (element) which should exhibit such advantageous characteristics as described above.

FIGS. 3, 4, 5, and 6, respectively show simplified schematic diagrams of the main parts of the microwave oven embodied by the present invention. In these Figures, drawings (a) respectively denote the bird's-eye views, whereas (b) respectively denote the schematic side views observed from the direction A.

In reference to the drawings, symbol 1 is the microwave oven itself, symbol 2 is the heating chamber, and symbol 3 is the controller unit. A blower inlet having a plurality of punched holes on the side panel 5 of the heating chamber is provided. One end of the first shape memory alloy spring 7 is secured to the stationary angle 6 that is mounted on the side panel 5 of the heating chamber 2. Damper unit 8 moves centering the shaft 9 so that the blower inlet 4 will be opened or closed. The other end of the first shape memory alloy spring 7 is secured to the center position of the damper unit 8. The AC power source 10 feeds the current directly to the first shape memory alloy spring 7, while the switch 11 turns ON only when the microwave heating is activated. Symbol 12 represents the second shape memory alloy spring vertically secured to the ceiling panel 13 of the microwave oven 1, while a weight 14 having a specific weight is provided in the lower portion of the second shape memory alloy spring 12. The other AC power source 15 feeds the current directly to the second shape memory alloy spring 12. Symbol 16 is the switch that turns ON when raising the weight 14.

A rectangular plate 17 is secured to the upper surface of the damper unit 8, where the rectangular plate 17 holds said weight 14 when the damper 8 is closed as shown in FIG. 1. Ball 18 is placed in the lowest tip portion of the weight 14 so that it smoothes the movement of the upper surface of the rectangular plate 17 when the damper unit 8 moves. Rod 19 is provided so that it protrudes from the side panel surface 5 of the heating chamber 2, where said rod 19 determines the positions of both the weight 14 held by said rectangular plate 17 and the ball 18 as well. Spring 20 is a bias spring having a stronger pressure force than the first shape memory alloy spring 7 when this alloy spring 7 is not being heated without any current being received. Spring 20 generates a pressure so that the damper unit 8 will always remain closed.

Sequential operations of the damper mechanism in connection with the shape memory alloy elements are described below.

Figure 3A:
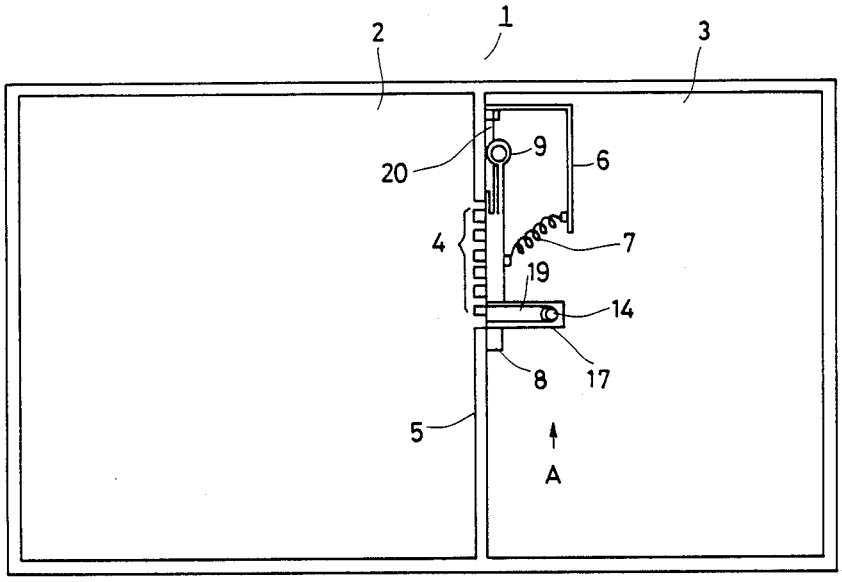
FIGS. 3, 4, 5, and 6, respectively show simplified schematic diagrams of the main parts of the microwave oven as a preferred embodiment of the present invention.
Figure 3B:
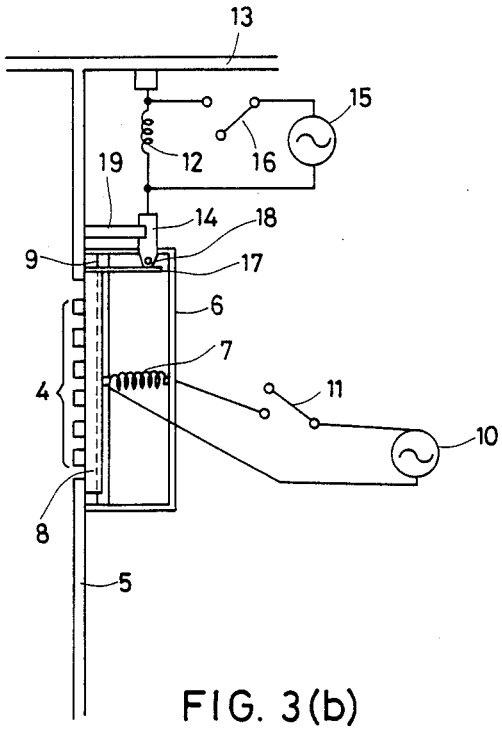

Although not illustrated, when performing an oven heating such as the one called "convection heating" by circulating hot air inside the chamber wherein hot air is heated by either the oven heating using the heater in the chamber 2 or by any heater, as shown in FIGS. 3(*a*), 3(*b*), the bias spring 20 causes the camper to move by effect of the pressure generated by the first shape memory alloy spring 7 so that the blower inlet 4 will be closed.

Although not illustrated, since the air that cooled the magnetron cannot enter the heating chamber 2, cooking can be efficiently performed in the heating chamber 2. During this period, no current is fed to both the first and second shape memory alloy springs 7 and 12, while the weight 14 and its tip ball 18 suspended by the second shape memory alloy 12 remain being held by contact with the upper surface of the rectangular plate 17.

Figure 4A:
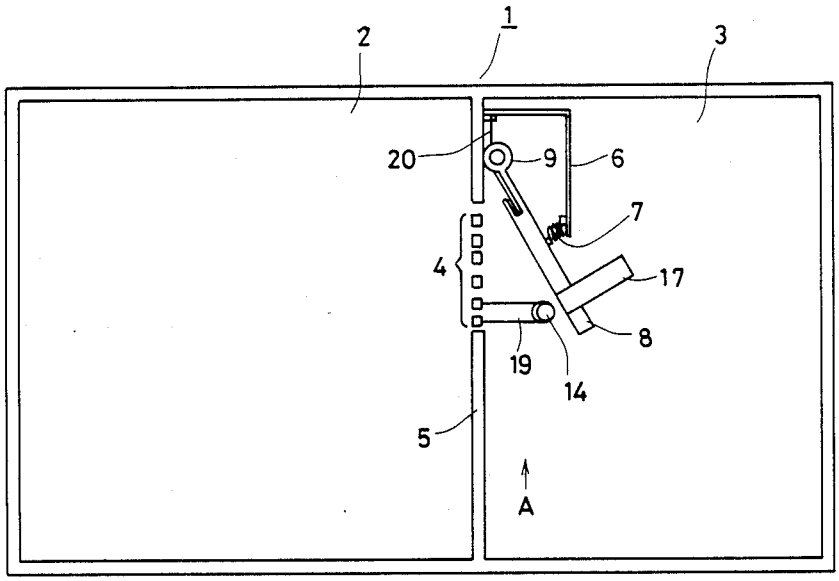
Figure 4B:
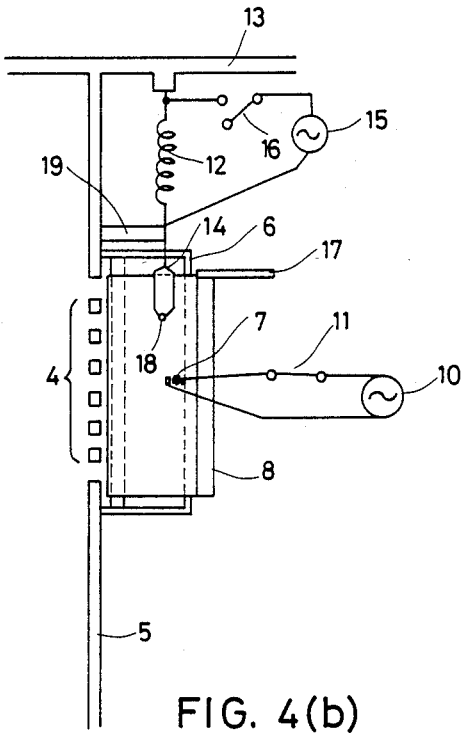

When performing microwave heating, although not illustrated, the AC power source 10 feeds the current directly to the first shape memory alloy spring 7 as soon as the oscillating magetron and switch 11 are connected to each other, and then temperature of the first shape memory alloy spring 7 rises within a short while. As a result, a motive force for returning to the original shape memorized during the contraction period will be generated, and so the damper 8 will be forced to move, centering the shaft 9 by the effect of the bias spring 20, as shown in FIGS. 4(*a*), 4(*b*) and as a result, the blower inlet 4 will be opened. During this period, since the rectangular plate 17 moves together with the damper 8, weight 14 cannot be held stationary, and so it descends by its own weight.

Figure 5A:
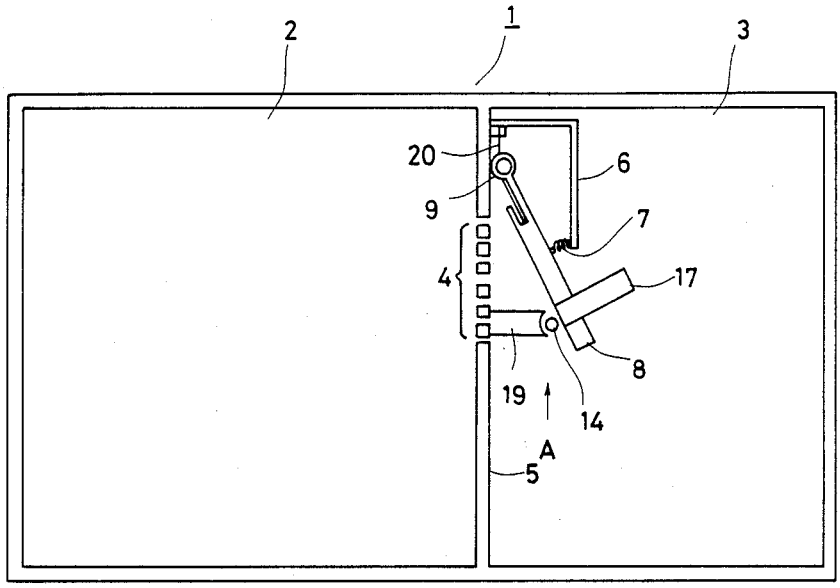
Figure 5B:
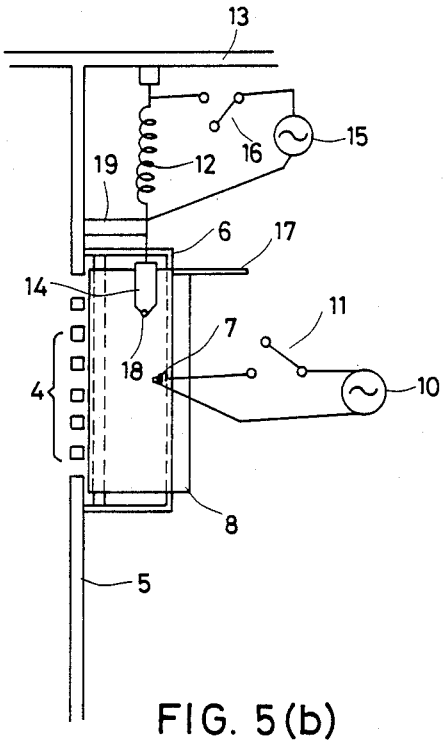

After these operations are completed, even if the AC current is cut off from the first shape memory alloy spring 7, as shown in FIG. 5, damper unit 8 can be held by the weight 14 so that the damper 8 will not move in the direction to close the blower inlet 4.

Consequently, when performing microwave heating, the shape memory alloy spring 7 can receive enough current within a short period of time, say 1 or 2 seconds, and after the current is cut off, the weight 14 will hold the damper 8 at the position where the blower inlet 4 opens.

Figure 6:
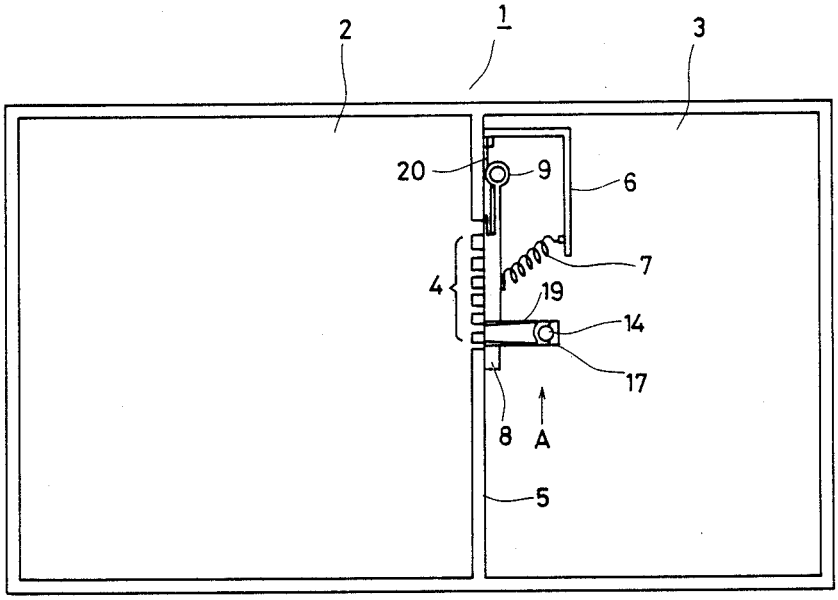
Figure 6B:
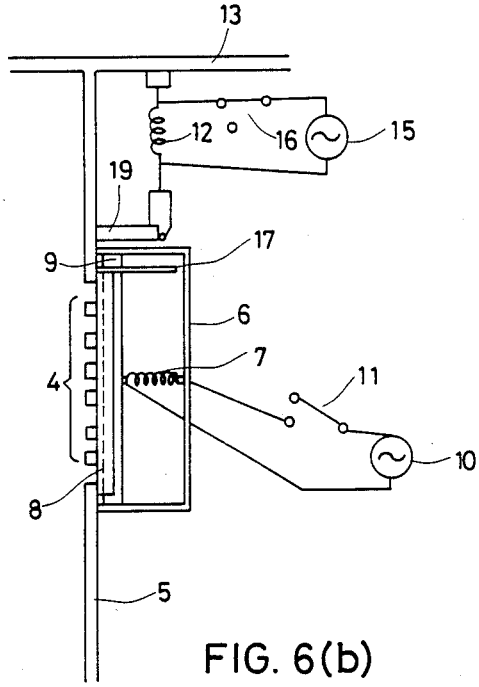

When sending the weight 14 back to the original position upwards, switch 16 is first closed so that the AC power source 15 can feed current to the second shape memory alloy spring 12, as shown in FIGS. 6(*a*), 6(*b*). This enables the second shape memory alloy spring 12 to return to the original contraction state as so memorized, and as a result, the weight 14 frees the damper 8 from the state of being retained. Then, centering the shaft 9, the damper 8 starts to move in the direction to close the blower inlet 4. Then, even if the current is cut off from the second shape memory alloy spring 12, since the rectagular plate 17 secured to the damper 8 will be placed in the position right below the weight 14, the second shape memory alloy spring 12 will decrease its pressure so that the weight 14 will slightly descend by itself. Consequently, the weight 14 will come into contact with the rectangular plate 17 at the tip ball 18, and so the weight 14 will be held as shown in FIGS. 3(*a*), 3(*b*).

By feeding the AC current to the first shape memory alloy spring 7 for a very short while, i.e., 1 to 2 seconds, the damper 8 can easily be activated.

If the blower inlet should remain being open for a specific period of time, damper 8 can be locked by means of weight 14 which can be set to the ceiling panel 3 of the microwave oven 1.

The present invention thus described in reference to the annexed drawings will obviously be suggestive of any derivation or modification from the spirit and scope desired therein by those who skilled in the arts. It should be understood, however, that the present invention is not limitative within the spirit and scope described above, but is intended to soley include all of such derivations and/or modifications within the spirit and scope of the following claims.

What is claimed is:

1. A combined oven having microwave and convection heating capability comprising:

a heating chamber having an air inlet port for introducing air into said heating chamber;

a damper operatively associated with said air inlet port for opening and closing said air inlet port of said heating chamber;

a first shape memory alloy spring element operatively connected to said damper for selectively controlling operations of said damper by controlled contraction and expansion, wherein during microwave heating, current is fed to said first shape memory alloy spring element so that a spring force causes said damper to open whereas when performing heating by a mode other than microwave, said air inlet port is closed by a force generated by a bias spring secured to said damper;

means for suppyling said current to said first shape memory alloy during microwave heating and for interrupting current supply to said first shape memory alloy during a heating mode other than microwave such that said first shape memory alloy is energized only during the microwave oven mode of operation and prohibited from operating during any other mode of operation other than the microwave oven mode;

a locking mechanism capable of retaining said damper in an open position, said locking mechanism comprising a weight means connected to a second shape memory spring element; and means for releasing said locking mechanism by applying current to said second shape memory alloy spring element.

* * * * *